United States Patent [19]

Fetterly

[11] Patent Number: 4,944,251

[45] Date of Patent: Jul. 31, 1990

[54] CONDENSATE RETURN TANKS

[75] Inventor: Richard Fetterly, Fulton, N.Y.

[73] Assignee: Fulton Boiler Works, Inc., Pulaski, N.Y.

[21] Appl. No.: 318,734

[22] Filed: Mar. 3, 1989

[51] Int. Cl.[5] ..... F22D 5/26

[52] U.S. Cl. ..... 122/451 R; 122/451 S

[58] Field of Search ..... 122/451 R, 451 S

[56] References Cited

U.S. PATENT DOCUMENTS 453,526 6/1891 Winder ..... 122/451 R

*Primary Examiner*—Edward G. Favors

*Attorney, Agent, or Firm*—Murray Schaffer

[57] ABSTRACT

A condensate return tank for storing and condensing water in a closed loop steam system is provided having a generally cylindrical body closed at each end and a float valve comprising a ball attached at one end to a lever arm which is itself attached at its other end to a pivotal fitting secured to the inner surface of the tank. The tank is arranged, and an opening is provided on the surface of the horizontally disposed tank, adjacent one end and spaced therefrom by a distance permitting manual entry into the tank. The float valve is mounted on the inner surface of the end so as to be accessible from the opening. A cap rests on and closes the opening.

5 Claims, 2 Drawing Sheets

CONDENSATE RETURN TANKS

BACKGROUND OF THE INVENTION

The present invention relates to boiler return systems and in particular to the construction of condensate return tanks for steam boilers in such systems.

Boiler return systems are well known for use in connection with various steam supply devices such as looped steam systems for dry-cleaning, pressing, and the like as well as in various processing plants requiring steam. One conventional condensate return system is marketed by the Fulton Boiler Works, Inc. of Pulaski, N.Y. Such system is illustrated in FIG. 1. The boiler system comprises a cylindrical tank 10 having square or flat front and rear ends 12. The tank 10 is mounted generally horizontally, as shown, in a closed loop with the boiler and the steam user, first to provide a storage facility for preheated water to be fed to the boiler and second to condense the used steam returned from the user. The tank may also be mounted vertically.

The tank 10 is connected to a high pressure pump 14, driven by a motor 16, and is provided with shut-off valves, gauges, overflow openings, and a drain. Mounted within the interior of the cylindrical tank 10 is a float valve (not shown) to monitor the level of the water in the tank and provide a control signal to the water source for refill. Access to the float valve, which required periodic adjustment, repair, or replacement, is made through a hole at the front end 12 of the tank 10. The hole is covered by a removable heavy end plate 18 secured by a plurality of bolts 20, requiring a gasket to seal the tank against leakage. In order to obtain access to the interior of the tank for repair of the float valve, for example, the tank must be drained below the level of the plate, the bolts and gaskets must be removed, and then the repair or adjustment made. Thereafter, a fresh gasket and the bolts must be replaced before the tank is filled.

It has been found that it is time consuming and costly to adjust the float valve or to repair the float valve in the conventional apparatus in view of the necessity of disassembling and reassembling the end plates, bolts, and gaskets. Further, the use of the heavy plate at the front end of the tank limits the level of water that can be stored in the tank.

It is an object of the present invention to provide an improved tank structure and float valve arrangement for boiler return systems which simplifies the structure known in the prior art and which is less costly to provide and which is easier to repair.

These and other objects will be apparent from the following disclosure.

SUMMARY OF THE INVENTION

In accordance with the present invention, a condensate return tank for storing and condensing water in a closed loop steam system is provided having a generally cylindrical body closed at each end and a float valve comprising a ball attached at one end to a lever arm which is itself attached at its other end to a pivotal fitting secured to the inner surface of the tank. In one embodiment the tank is arranged horizontally, and an opening is provided on the surface of the horizontally disposed tank, adjacent one end and spaced therefrom by a distance permitting manual entry into the tank. The float valve is mounted on the inner surface of the end so as to be accessible from the opening. A cap rests on and closes the opening.

Preferably, the tank includes a pipe extending upward within the opening to support the cap, and the pipe is covered by a cap which is held in place by gravity. The ends of the tank are dish-shaped and distend dome-like outwardly of the tank. The ends are separately formed and slip fit over the ends of the tank and are welded thereto.

Because the tank ends are no longer provided with a cover plate which is removable the present invention allows for a higher water volume within the tank, thus providing a high pressure head for feeding the water to the boiler. Further, the tank is less susceptible to vapor lock.

A further advantage lies in the fact that the float can be repaired without draining the tank.

These advantages as well as other advantages, together with the details of the invention, will be observed from the following description of the invention and its illustration in the accompanying drawings.

BRIEF DESCRIPTION OF THE INVENTION

Figure 2:
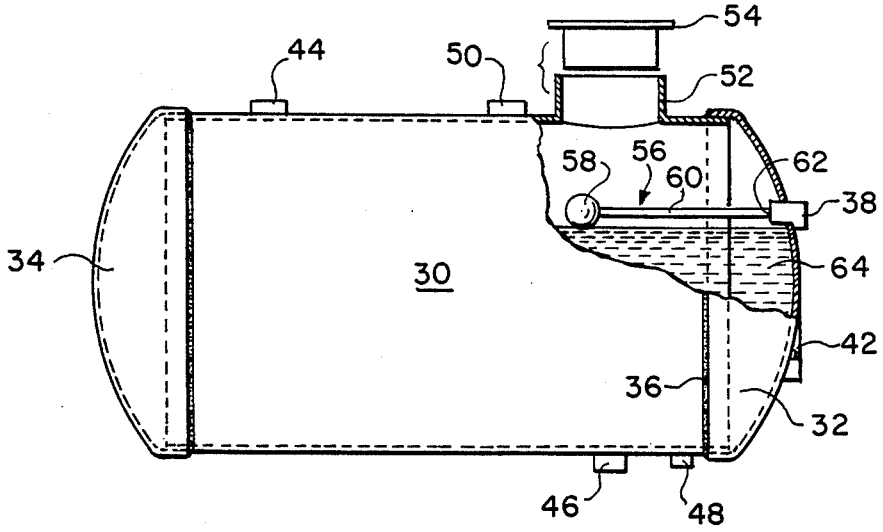
FIG. 2 is a side elevational view partially in section of a condensate return tank embodying the present invention.
Figure 3:
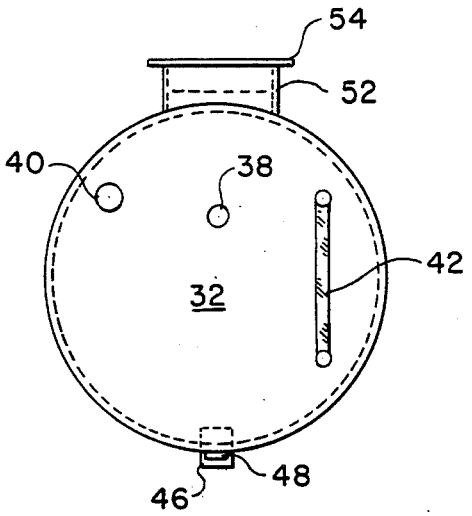
FIG. 3 is an end view of the tank shown in FIG. 2.

The present invention embodied in a horizontal tank is illustrated in FIGS. 2 and 3. The condensate return tank 30 comprises a cylindrical body, closed at its front and rear ends by dome-shaped or distended heads 32 and 34. The heads 32 and 34 are separately made from the tank 30 and slip fit over the respective ends to form an overlapping joint which is then welded to the body in conventional manner to form a liquid tight welded seam 36 sealing the tank. In addition to the seam weld, a band of reinforcing material may be welded over the seamed portion. Each of the heads 32 and 34 are devoid or absent any end plate or removable plate as known in the prior art. On the other hand, the front dished end is tapped to provide for the mounting of an inlet filling 38 adapted for connection to a fresh water source. The front end 32 is also provided with an overflow outlet 40 and a water level sight glass 42.

A steam return 44 is provided at the upper surface of the tank 30 connected to the steam user, while at the bottom of the tank there is provided a water outlet 46 for connection to the steam boiler. A drain 48 and an air vent 58 are also provided.

In accordance with the invention, the top of the tank 30 is provided with an upstanding stub pipe 52 at its upper end, providing an opening into the tank. The pipe 52 is provided with a removable cap 54 covering it. The pipe may be welded to the tank or otherwise secured therewith as by tapping. The cap 54 preferably fits over the pipe 52 and is held in place by gravity. On the other hand, the cap 52 can be secured to the pipe 50 by screw threads, bayonet fit connection, or the like in any simplified type of connection. Because the pipe 52 is not subject to any water flow or any degree of pressure the cap 54 need not be securely attached by bolts or the like, and a gasket is not necessary. In practice the pipe is about 6 inches in diameter, allowing entry of a repairman's or operator's arm and tools.

The cap is in the shape of a hat, the skirt of which sits in the pipe and is held therein by gravity. The cap and pipe thus provide a form of air vent, permitting escape of air trapped in the tank. As a result, even if the vent 48 should stick or be inadvertently shut, the tank will be sufficiently vented through the access opening 52. Thus, an air gap trap will be avoided, and the tank will be prevented from overpressurization.

Mounted on the inner surface of the front end 32 of the tank 30 to the inlet fitting 38 is a float valve 56. The float comprises a ball 58 mounted at the end of an arm 60 which is pivotally attached at 62 to the fitting so as to extend cantilevered into the tank 30 and float on the surface of the water 64 in the tank. Thus, should the level of water in the tank fall below a predetermined level, the float valve opens and water from a fresh source is introduced into the tank. When repair, adjustment or replacement of the float valve is required, access to the interior of the tank can be easily made simply by lifting the cap.

Figure 1:
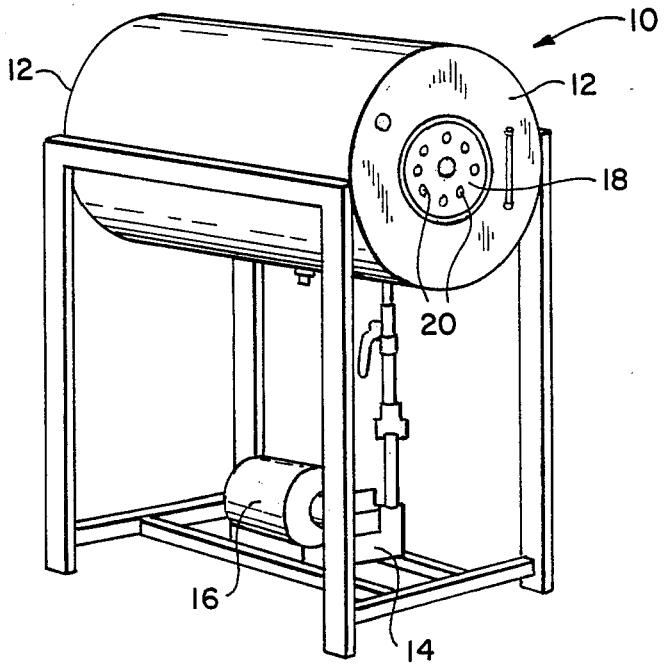
FIG. 1 PRIOR ART
FIG. 1 is a perspective view of a condensate return tank of the prior art.
Figure 4:
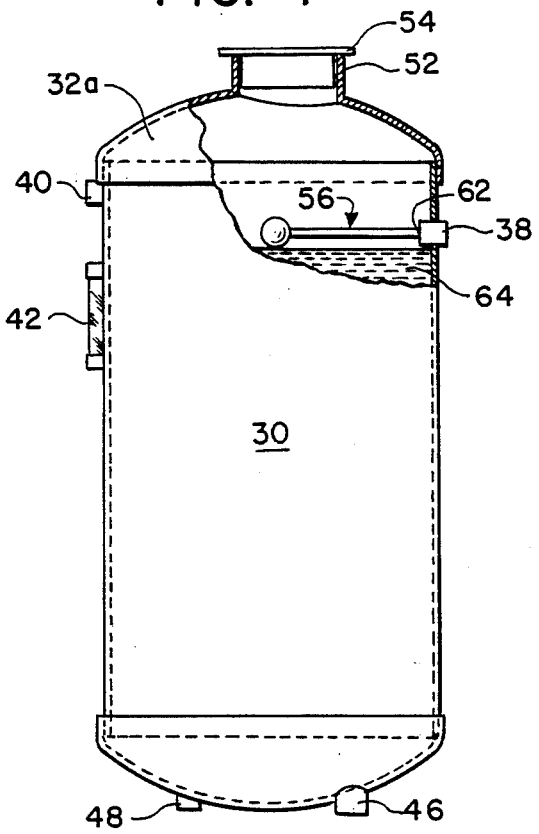
FIG. 4 is a side elevational view of a second condensate return tank embodying the present invention.

The tank of the present invention can be mounted in any conventional manner such as that shown in FIG. 1 with the pump and motor located therebelow. It may also be arranged in a vertical position, as seen in FIG. 4, in which case the pipe 52 forming an access opening into the tank is provided on the upper one the dished or distended ends 32*a*. The fresh water inlet filling 38 is here tapped into the side wall of the body 30 just below the upper end 32*a* so that the float valve 56 can be mounted adjacent to the dish to extend inwardly. Otherwise, the remaining construction of the tank may follow any conventional form, except that the sight glass 42 is preferably mounted on the side wall rather than the end 32*a*, and the outlet to the pump and the drain are tapped in the lower end 34*a*.

It will be seen from the foregoing that the present invention simplifies the construction of the condensate tank, thus simplifying the return system for the automatic boiler return systems. The tank is simpler to make, and the interior is more easily accessible through the top, which does not have to be bolted.

The tank may also be adapted to contain a greater volume of water, thus reducing the load on the pump to the steam boiler, resulting in less wear on the pump, extending pump life. Because of the fact that the access pipe 52 is open to atmosphere the commonly used separate vent can be omitted.

Various modifications, changes, and embodiments are set forth herein. Those skilled in this art will be aware of others. Therefore, it is intended that the present disclosure not limit the scope of the invention.

What is claimed is:

1. A condensate return tank for storing and condensing water in a closed loop steam system, comprising a horizontally arranged generally cylindrical tank closed at each end, a float valve comprising a ball attached at one end to a lever arm which is itself attached at its other end to a pivotal fitting secured to the inner surface of one of the ends of said tanks so that said ball extends cantilevered therefrom to float on the surface of the water in said tank, an opening on the surface of said horizontally disposed tank, adjacent the one end of said tanks and spaced therefrom by a distance permitting manual entry into the tank in contact with said float valve, and a cap resting on and forming an air vent permitting escape of air from said tank.

2. The tank according to claim 1 including a pipe extending upward within said opening to support said cap.

3. The tank according to claim 1 wherein said cap is held in place by gravity.

4. The tank according to claim 1 wherein the ends of said tank are dish-shaped and distend dome-like outwardly of said tank.

5. The tank according to claim 4 wherein said dish-shaped ends are separately formed from the body of said tank, said body being formed with open ends and said dish-shaped ends being slip fit over the ends of said tank and welded thereto.

* * * * *